United States Patent [19]

Roberts

[11] 4,382,367

[45] May 10, 1983

[54] CONTROL OF VAPOR COMPRESSION CYCLES OF REFRIGERATION SYSTEMS

[75] Inventor: Ian D. Roberts, Victoria, Australia

[73] Assignee: The University of Melbourne, Victoria, Australia

[21] Appl. No.: 289,984

[22] Filed: Aug. 4, 1981

[30] Foreign Application Priority Data

Aug. 5, 1980 [AU] Australia ..... PE4869

[51] Int. Cl.[3] ..... F25B 41/00

[52] U.S. Cl. ..... 62/197; 62/225

[58] Field of Search ..... 62/197, 225, 224, 528, 62/117

[56] References Cited

U.S. PATENT DOCUMENTS 2,056,401 10/1936 Hoesel ..... 62/197 X
2,323,408 7/1943 Miller ..... 62/197 X
2,353,240 7/1944 Huggins ..... 62/197
3,196,630 7/1965 Barbier .
3,537,272 11/1970 Hales et al. .
3,842,616 10/1974 Orbesen .
3,875,757 4/1975 Amano .

FOREIGN PATENT DOCUMENTS 2429396 7/1969 France .

*Primary Examiner*—William E. Wayner
*Attorney, Agent, or Firm*—Bernard, Rothwell & Brown

[57] ABSTRACT

A vapor compression cycle refrigeration system of the type having the expansion valve (11) controlled by a temperature sensing bulb (12) at the downstream end of the evaporator (5). A by-pass line (15) is provided from the expansion valve outlet to the evaporator (5) to inject wet vapor upstream from the temperature sensing bulb (12) and provide proportioned negative feedback to the expansion valve (11) to reduce hunting or oscillating of the system.

Variations of the by-pass line are also described to give positive feedback and combinations giving integral and derivative action.

10 Claims, 11 Drawing Figures

Figure 2:
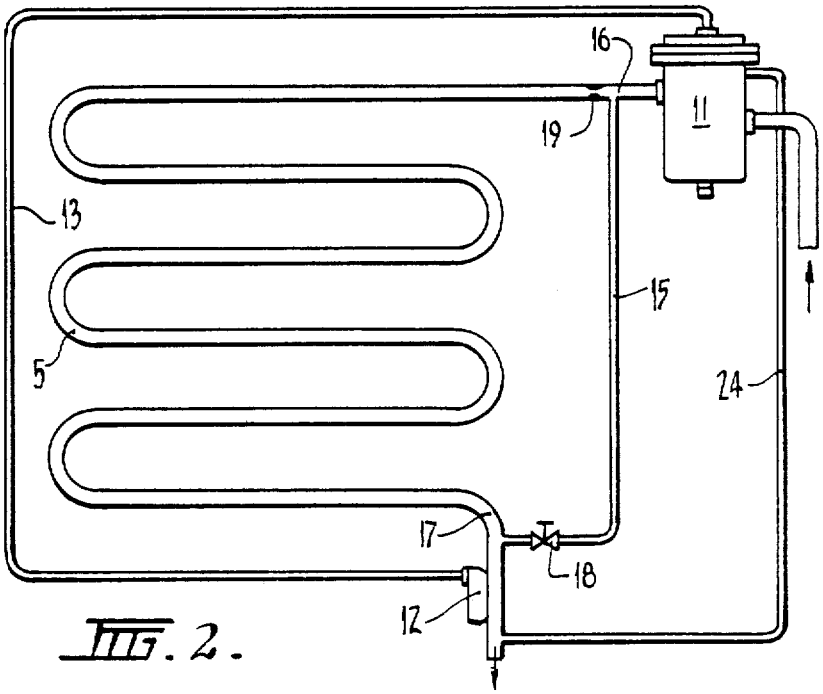

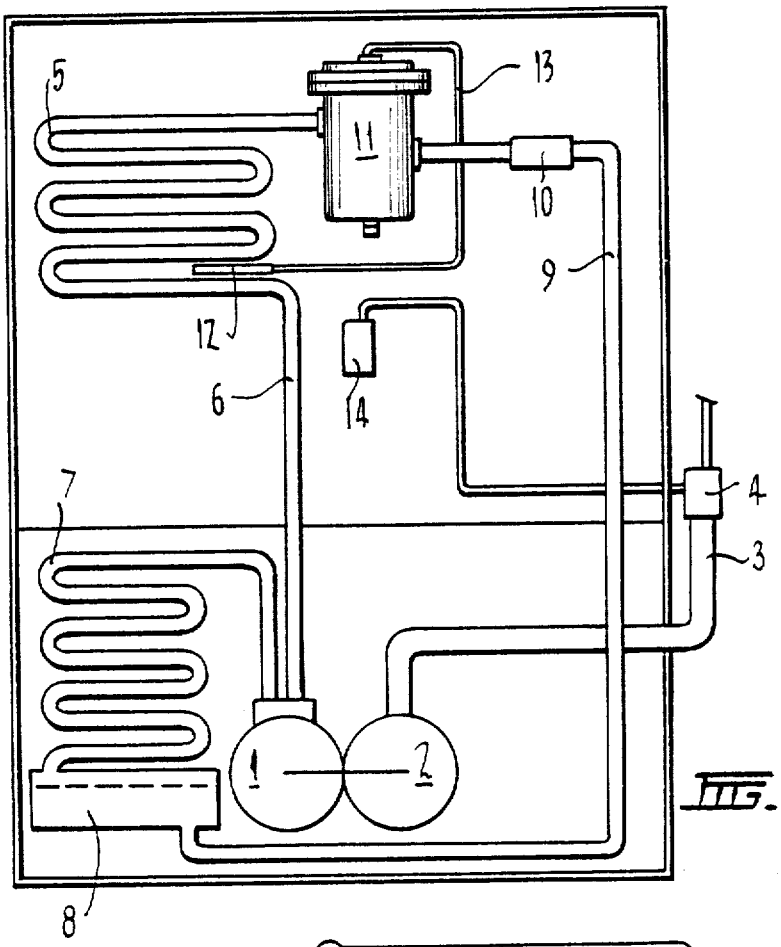
FIG. 1.
FIG. 5.
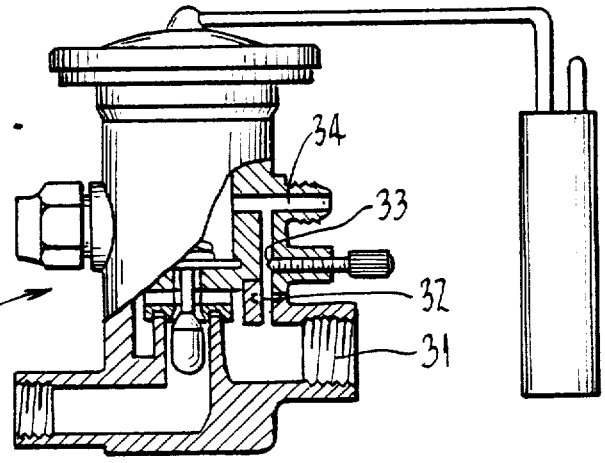

CONTROL OF VAPOR COMPRESSION CYCLES OF REFRIGERATION SYSTEMS

This invention relates to improvements in the control of vapour compression cycle refrigeration systems.

The problem of lack of stability in refrigeration systems controlled by a thermal expansion valve (TX valve) has been the subject of many papers and experiments since this form of control was introduced. For example in "The Journal of Refrigeration" Vol. 6 No. 3, the following statement is made:

"In the development of automatic refrigeration the thermostatic expansion valve has played a vital part in the past and continues to do so still. As a means of regulating the flow of refrigerant into an evaporator to equal the rate at which vapour is pumped out by the compressor without demanding a large evaporator charge as does the low-side float control and without being unduly sensitive to total charge as is the high-side float control, it is still the preferred method for commercial and much industrial plant. Recent years have seen the adoption of the thermostatic valve in larger sizes and it is possible that this trend will continue.

Nevertheless it must be admitted that the TX valve is not always the most efficient method of using evaporator surface. In principle it can be and often is efficient but there are many examples of its use in which this is not so. Under ideal operating conditions the valve should admit just the right amount of refrigerant which can be evaporated and slightly superheated, then the evaporator should be wetted to the maximum extent with a correspondingly good heat transfer rate. (Though even under these ideal conditions it is not always realized how much evaporator surface is needed to provide the normal superheat.) At the other extreme when the valve is limit-cycling or hunting between its fully open and fully closed positions the evaporator is completely wetted for part of the time and starved from the remainder. The period of full wetting does not compensate for the period of starvation and poor overall heat transfer is the result. At a time when intensive efforts are being made to improve the rate of heat transfer to boiling refrigerant it seems that means of improving the evaporator feed should be investigated also, since any improvement obtained in one might be nullified by carelessness about the other".

The article from which the above two paragraphs were taken was written in 1963 but the same problems still exist. (See "Refrigeration and Air Conditioning" February 1979 at Page 42 and more recently "Transactions of the A.S.M.E." Volume 102 June 1980 at Page 130. This latter article proposes a mathematical model to describe the hunting of evaporators controlled by a thermostatic expansion valve but does not propose any solution other than the technicians field solution of insulating the temperature sensing bulb from the evaporator tube wall by one or more layers of insulation tape. This solution tends to negate the advantages the TX valve has over other simpler device. This is despite a considerable amount of research aimed at determining the criteria governing the stability of vapour compression cycles (V.C.C.) systems and particularly those systems controlled by the widely used Thermostatic Expansion Valve (TX valve).

Stoecker, Danig and others have analysed the stability problem using control theory techniques (see (1) "Journal of Refrigeration" Volume 6 No. 3, May/June 1963 pp 52–55;

(2) "ASHRAE Transactions" Volume 72 Part 11 pp 1V3.1 to 3.7;

(3) "ASHRAE Transactions" 1971–72 pp 80 to 87). Stoecker also looked at the behaviour of the refrigerant inside the evaporator and at the motion of the transition point. (see (4)"ASHRAE Transactions" Volume 72, Part 11, pp 1V2.1 to 2.15; and (3) "ASHRAE Transactions" 1971–72 pp 80 to 87). This he define as being the position in the evaporator where the last of the liquid is vaporised and is the boundary between the two-phase region and the superheated region. The conclusions reached using control theory are not numerically precise but nevertheless they show what combination of characteristics is most likely to give stability, for example, the effect of time lags is demonstrated as is the effect of varying the gain of the TX valve.

Heulle ("Proceedings of Industrial Congress of Refrigeration" 1967 Volume 3.32, 3.33 pp 985 to 1010) and others have taken a different more empirical approach. Like Stoecker, Heulle investigated the motion of the transition point but he formed the conclusion that stability can be achieved by sizing and adjusting the TX valve so that the transition point never reaches the position where the bulb is located.

The following observations can be made based on work leading to the present invention:

1. The importance of preventing the transition point from going past the exit of the evaporator and reaching the location of the bulb can, in practice, be seen. However, as shown by Stoecker and Danig, this is not the only criteria for stability and therefore, a system with the TX valve sized accordingly to Heulles' recommendations may not always be stable.

2. If a system is controllable and is thus within the limits defined by Stoecker and Danig, then Heulles' methods for sizing the TX valve appears applicable.

3. Hunting results in wide variations in evaporator saturation pressure/temperature (see FIG. 10) but this has been ignored to simplify the system, for the purposes of analysis, in all the work carried out in the references. This may have resulted in a considerable underestimation of the problem as when the system is hunting (i.e. unstable) variations in saturation (evaporator) temperature/pressure can be shown to add approximately 50% to the total amplitude of the superheat oscillations.

It is therefore an object of the present invention to provide a refrigeration system which will obviate or minimize the hunting or oscillating problems described above and will improve the stability and controllability of the system or which will at least provide the public with a useful choice.

The invention is primarily for use in V.C.C. systems controlled by the "Thermal Expansion Valve" (TX valve). It is however of equal use in systems controlled by any form of expansion valve in which one of the measured variables is the temperature or vapour dryness at the downstream end of the evaporation zone. Therefore in the following description the term "TX valve" should be understood to include any expansion valve.

Accordingly the invention consists in a refrigeration system including an evaporator controlled by an expansion valve having means for sensing the temperature at the downstream end of the evaporator, characterized by means for injecting wet vapour at a rate which is a function of the rate of flow of refrigerant through the expansion valve into said evaporator upstream of said temperature sensing means.

In one embodiment of the invention a wet vapour by-pass line is connected to the evaporator between a position immediately downstream of the expansion valve and a position immediately upstream of the thermal sensor. In another embodiment a similar wet vapour by-pass line is provided between a position immediately downstream of the expansion valve and a position a predetermined distance upstream of the thermal sensor so that the wet vapour entering the evaporator from the by-pass line is heated by the evaporator surface before reaching the thermal sensor.

Figure 3:
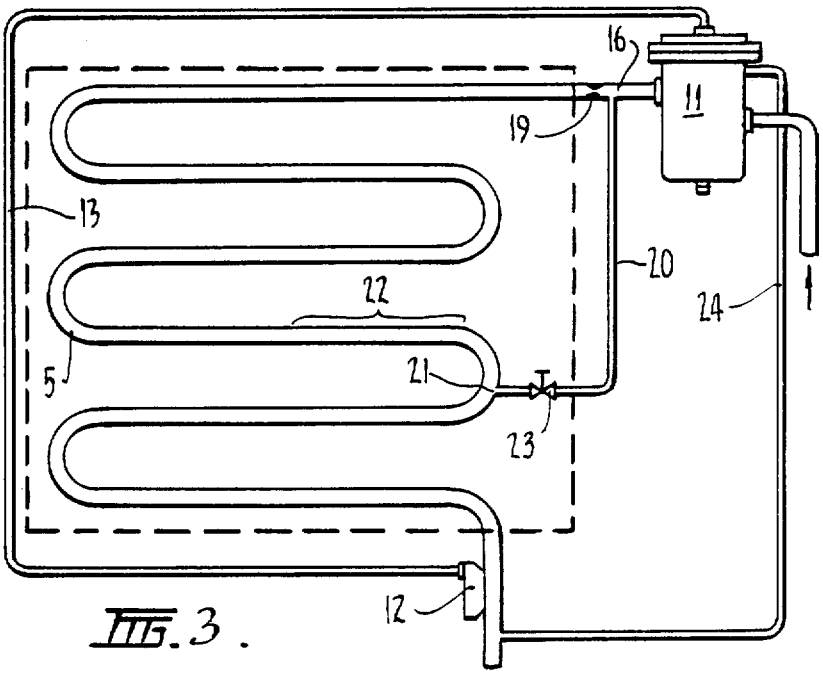

Notwithstanding any other forms that may fall within its scope one preferred form of the invention and variations thereof will now be described with reference to the accompanying drawings in which:

FIG. 1 is a diagramatic view of a standard vapour compression cycle refrigeration system, FIG. 2 is a diagramatic view of a TX valve and evaporator with a wet vapour by-pass line according to one preferred form of the invention, FIG. 3 is a diagramatic view similar to FIG. 2 showing wet vapour injection into the evaporator, some distance upstream of the temperature sensor.

Figure 4:
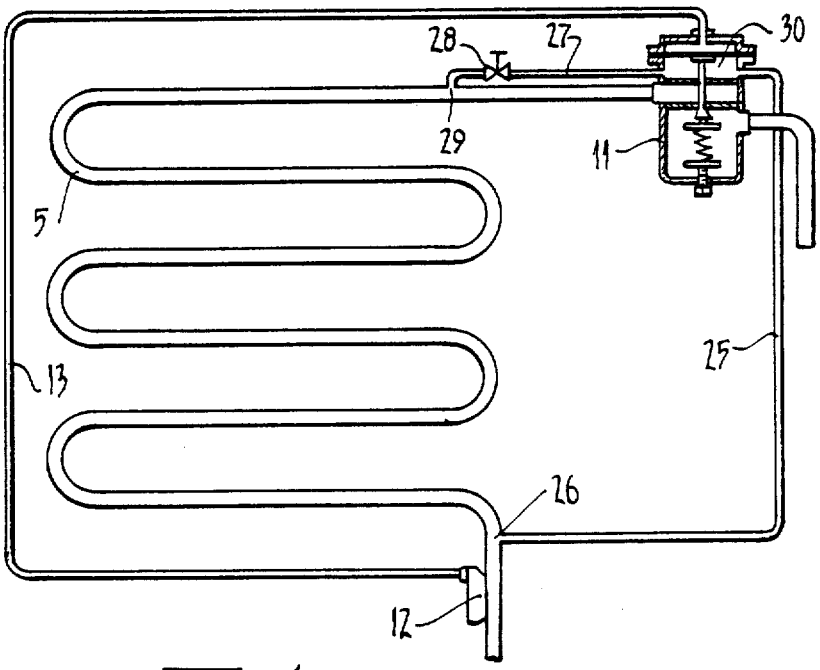
Figure 6:
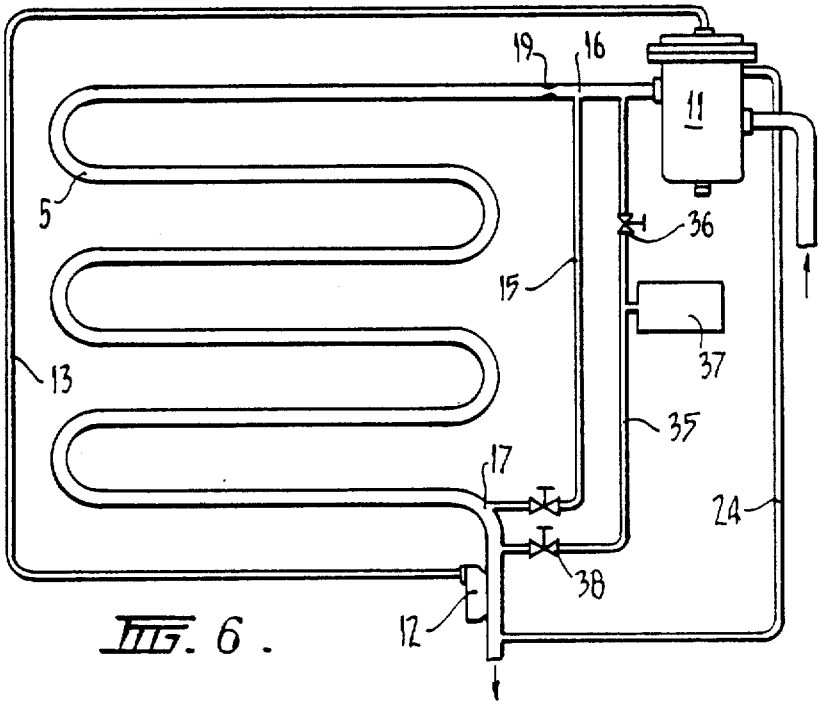
Figure 7:
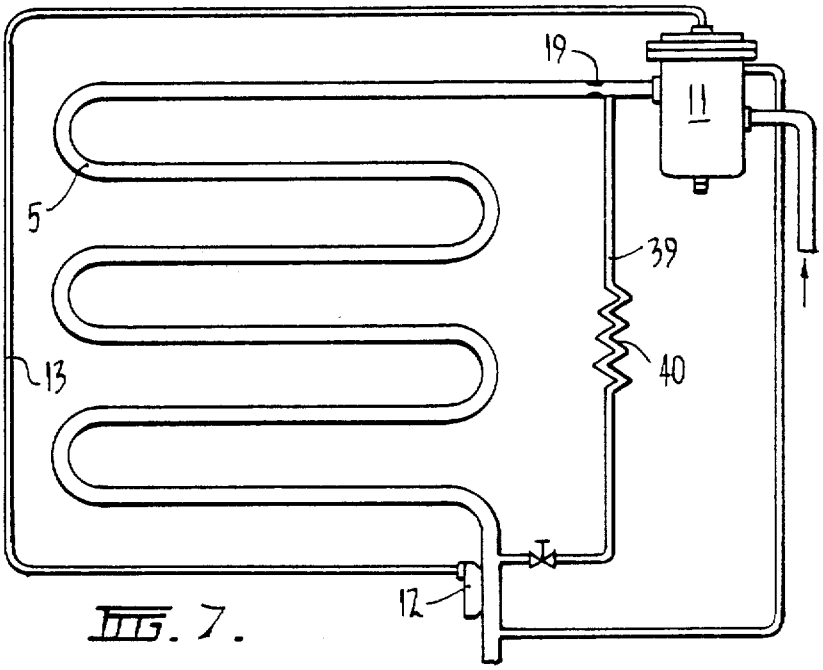

FIG. 4 is a diagramatic view of a TX valve and an evaporator according to the invention showing a modification using the pressure equaliser line as the wet vapour injection line, FIG. 5 is a partially cut away cross-sectional view of a TX valve having a built in by-pass to enable the equaliser line to be used in the configuration shown in FIG. 4, FIG. 6 shows a wet vapour injection system used to obtain proportional and derivative control of the TX valve, FIG. 7 shows an evaporator and TX valve with positive feed back, (hot gas injection)

Figure 8:
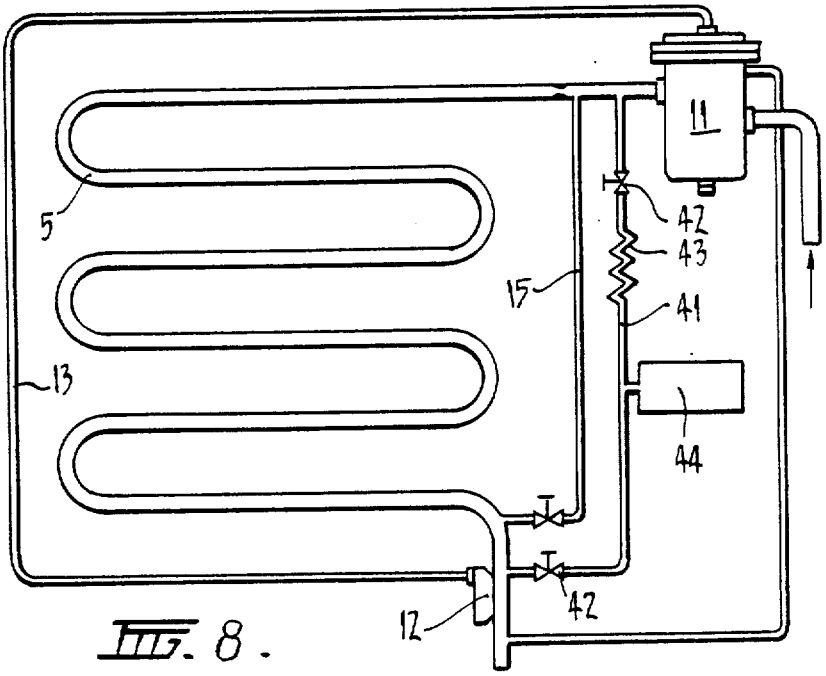
Figure 9:
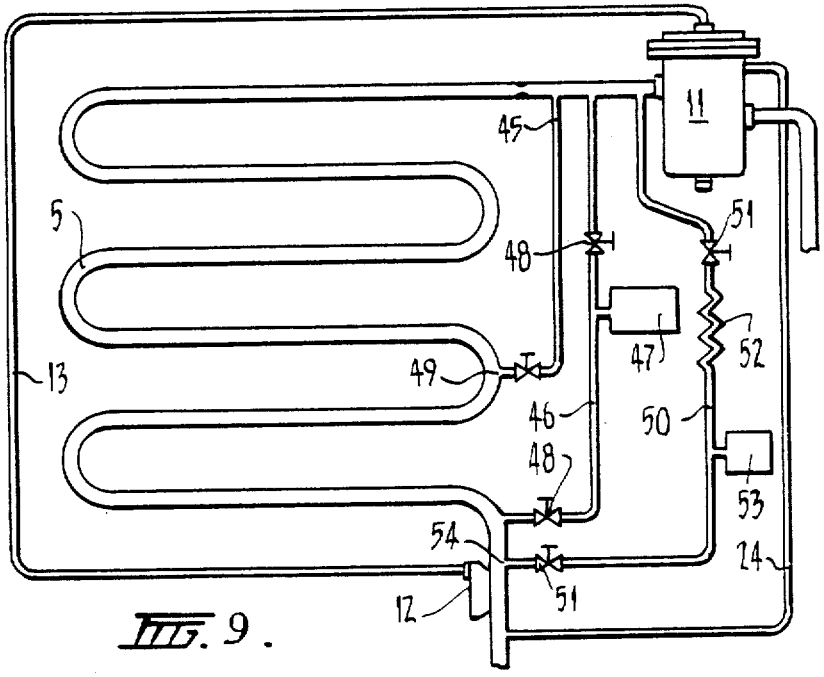
Figure 10:
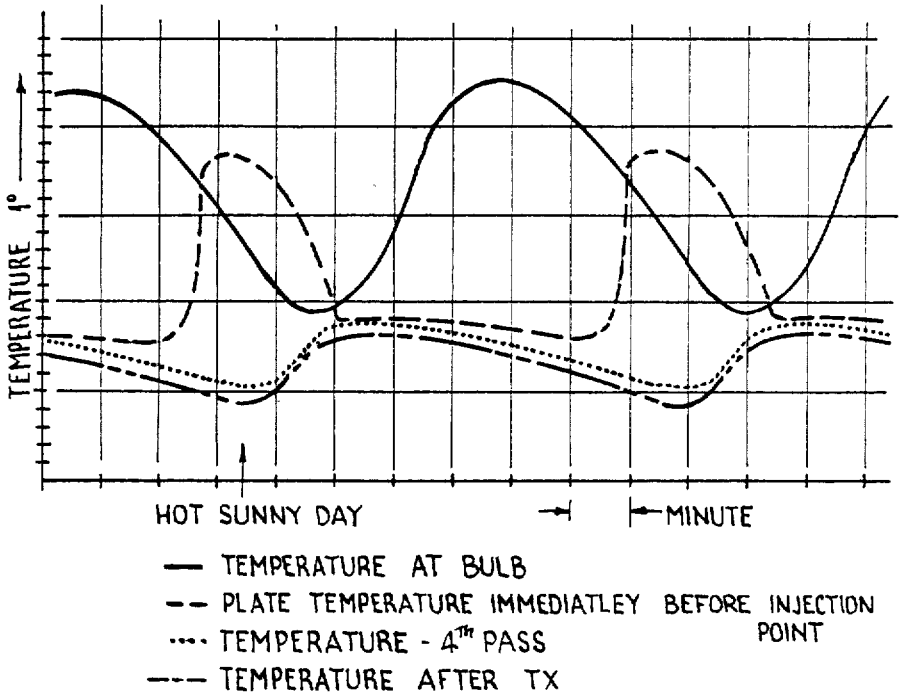
Figure 11:
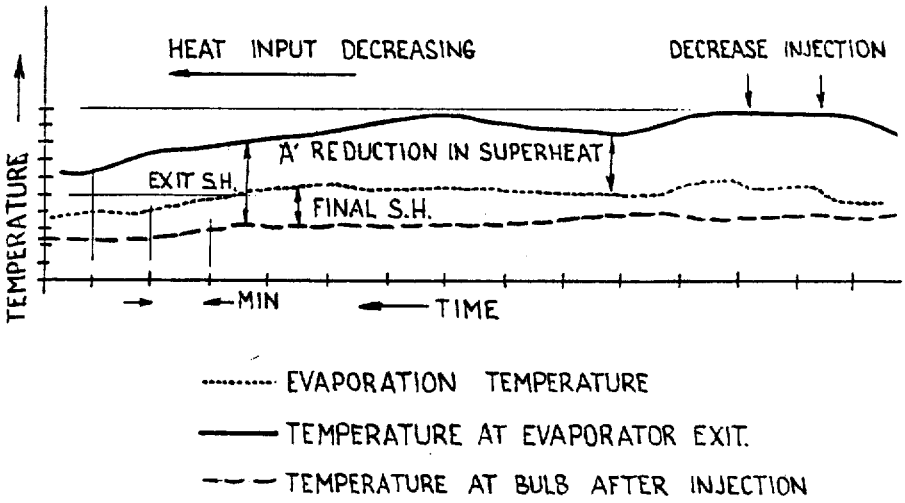

FIG. 8 shows a hot gas injection system used to obtain proportional and integral action, FIG. 9 a system with modifications giving proportional, integral and derivative action, FIG. 10 is a chart showing the hunting action of a normal TX valve controlled refrigeration system and, FIG. 11 is a chart showing the performance of a system having the wet vapour injection shown in FIG. 2.

In a normal refrigeration system controlled by a thermostatically controlled expansion valve (TX valve) the system comprises a compressor 1 driven by a motor 2 for example an electric motor provided with power through wires 3 from a control box 4. The compressor draws refrigerant from an evaporator 5 through a suction line 6 and pumps the refrigerant at increased pressure through a condensor 7 to a liquid receiver 8 from where it passes through line 9 to a filter dryer 10. The refrigerant then passes at a controlled rate through a TX valve 11 into the evaporator 5. The TX valve is controlled by evaporator pressure (which is directly relative to the evaporation temperature) and also by the temperature at the evaporator outlet sensed by temperature sensing bulb 12 and fed as a pressure signal to the TX valve through line 13. The motor 2 may also be controlled by a thermal element 14. As this system is well known the modifications thereto which comprise the invention will be described below with reference solely to the components comprising the TX valve 11 the evaporator 5 and the temperature sensing bulb 12.

The basis of the invention is the utilization of a TX valve sensor and in particular the bulb 12 as a summing device, the temperature which the sensor detects having been increased or decreased by a controlled amount which is dependent on the flow through the TX valve. Thus the temperature which, say the bulb detects, is altered such that it becomes the evaporator exit temperature ± some alteration "A". (See FIG. 11)

The magnitude of the Alteration "A" is arranged to be a function of the flow through the TX valve, "F" and therefore $A=f(F)$. If this is done a closed loop is created and the input signal to the TX valve is now the original input signal $\pm f(F)$. As Flow "F" is the output from the TX valve then the input signal can be described as: the original 'true' input signal ± feedback. If "A" is also made a function of time 't' i.e. $A=f(F,t)$ then we have time dependent feedback.

Thus control of a refrigeration system can be improved by making the bulb's signal to the TX valve equal the immodified signal plus A and:

1. Incorporating negative feedback i.e. $A=-f(F)$;

2. Incorporating positive time dependent feedback, i.e. $A=f(F,t)$, arranged to give integral action;

or 3. Incorporating negative time dependent feedback, i.e. $A=-f(F,t)$, arranged to give derivative action.

or a combination of the three.

Basically (1) improves linearity and enables the gain to be easily adjusted (2) works to eliminate the offset inherent in proportional-only controllers, and (3) gives increased response to rapid changes in input. Straight positive feedback ($A=f(F)$) is not likely to be used as that maximum gain can be arranged to be above the anticipated operational maximum by the correct selection of controller (TX valve) components.

In a TX valve controlled system a negative "A" applied to the exit of the evaporator will give negative feedback as the measured degree of superheat will be reduced by "A" which is a function of the flow. Thus the opening of the TX valve, and, therefore the flow, will be reduced by an amount proportional to the flow.

In the first and simplest embodiment of the invention as shown in FIG. 2 wet vapour injection is used to provide negative feedback to control the gain of the TX valve. This is achieved by providing a wet vapour by-pass line 15 between the inlet to the evaporator at a point 16 just downstream of the TX valve 11 and a point 17 at the downstream end of the evaporator 5 and just upstream of the TX valve sensor bulb 12. The flow rate through the by-pass line 15 can be controlled by a regulating valve 18. A restrictor 19 is preferably placed just downstream of the junction 16 to make the pressure in the by-pass injection line 15 respond primarily to the flow through the TX valve itself. In many systems a suitable restrictor is present in the form of the distributor. Alternatively a "pitot tube" or upstream facing type of pick-up may be used at junction 16.

Thus wet vapour is injected just upstream of the bulb 12 and the temperature at this point is altered accordingly. The amount of vapour injected is a function of the flow through the TX valve and therefore $A=-f(F)$ which, as stated previously, gives a form of negative feedback. The volume enclosed by the restrictor, the TX valve and the injection control valve should be kept to a minimum, to keep time lags as small as possible.

The injected wet vapour has the beneficial side effect of reducing fluctuations in, and lowering, the suction (from the evaporator) gas superheat. The point of injection should be far enough upstream of the bulb to allow complete mixing and maximise the effects discussed above. If the injection point is close to the bulb, only a minute amount of injection is required as there is considerable local chilling of the tube walls near the injection point, although the gas temperature after mixing will be hardly altered.

As the amount of heat needed to change the superheat of a refrigerant is relatively much smaller than the latent heat of vapourisation, only a very small amount of refrigerant need be injected to alter the evaporator exit temperature.

The injection of wet vapour into the superheated gas leaving the evaporator chills the walls of the pipe work to well below the temperature attained after mixing is complete. This phenomenon which is caused by the evaporating wet vapour being forced by the gas out into the tube walls (annular flow) increases the ability of the region immediately downstream of the injected point to pick up heat from the heat source. Therefore by injecting into the latter part of the evaporator itself, preferably downstream of the wet vapour to superheat transition point, changes in heat input to the evaporator are quickly detected by the bulb which is located at the downstream end of this zone. This is achieved as shown in FIG. 3 by joining the wet vapour by-pass line 20 with the evaporator 5 at a junction point 21 in the evaporator which is upstream from the downstream end of the evaporator but is ideally downstream from the transition point which may for example be located in the region 22. The flow rate through the by-pass line 20 is again controlled by a valve 23. As in the configuration shown in FIG. 2 the bulb 12 is effectively being used as a summing device. If the modification shown in FIG. 3 is used then the temperature detected by the bulb is the evaporator exit temperature plus a feedback component, plus a heat input component (from the portion of the evaporator between the junction point 21 and the bulb 12).

This modification also seeks to counteract the 'inversed' signal which is received by the TX valve immediately after a rapid change in heat input. This effect is caused by the saturation temperature/pressure changing much faster than the temperature at the exit of the evaporator. Thus after, say, an increase in heat input, the saturation temperature/pressure (detected through the equaliser line 24) rises before the evaporator exit temperature (detected by the bulb) and the TX valve sees a fall in superheat. Initially, therefore, until the evaporator exit temperature also rises, the TX valve closes instead of opening. By making the evaporator exit temperature more responsive to heat input, the configuration shown in FIG. 3 can be seen as to oppose this effect and reduce it to a more acceptable level.

Although the invention described with reference to FIGS. 2 and 3 has shown a separate wet vapour by-pass line (15 or 20) it is possible to achieve the same effect by using the equalizer line 24 to feed wet vapour at a rate which is a function of the flow rate through the TX valve, into the evaporator upstream from the sensing bulb 12. This configuration can be seen in FIG. 4 where the equalizer line 25 has been rerouted to enter the evaporator at a junction point 26 just upstream of the bulb 12 (rather than downstream from the bulb as shown in FIGS. 2 and 3). The TX valve 11 is provided with an external by-pass line 27 controlled by a flow rate valve 28 to by-pass wet vapour from a junction point 29 immediately downstream from the TX valve (shown for clarity in FIG. 4 as back through the chamber 30 in the valve) to the equalizer line 25 and thence to the junction point 26. In this manner the pressure equalizer line 25 can be used as the wet vapour injection line and so obviate the necessity to provide a separate line as shown in FIGS. 2 and 3. In a further embodiment of the invention the by-pass line 27 and valve 28 may be incorporated into the TX valve as shown in FIG. 5. In this configuration the outlet 31 from the TX valve is provided with an internal by-pass 32 controlled by needle valve 33 to the equalizer line outlet 34. The passage 32 is the equivalent of the external by-pass line 27 and the needle valve 33 the equivalent of the flow rate control valve 28 shown in FIG. 4.

In situations where it is desired to provide even further control over the TX valve than the variable sensitivity "proportional action" control described so far it is possible to take the concept further and provide integral and derivative action by adaption of the principles described above. FIG. 6 shows a system modified in such a way as to incorporate derivative action as well as the wet vapour injection system described above. Negative time dependent feedback is required and a second wet vapour injection system has been added, modified so that injection increases with time as well as flow. This is achieved by providing a second by-pass line 35 in parallel with the original by-pass line 15 and providing the line 35 with a restrictor valves 36 and 38 and a volume capacity 37. Although the time lag in this case has been achieved using a capacity and restrictors this is not mandatory and other methods such as using thermal inertia to generate the time lag by delaying the effects of the injected wet vapour are applicable.

In some cases it may be desirable to use positive feedback to the TX valve and this is achieved by the configuration shown in FIG. 7. This is identical to the configuration used to provide negative feedback (as shown in FIG. 2) except that in this case the vapour passing through the by-pass line 39 is heated in a heater 40 until it becomes highly superheated. The heating stage can be arranged so that heat is obtained from the same source as the evaporator. Alternatively the heat may be drawn from the casing or the sump of the compressor. Any heat source will achieve the desired result and the final choice must be made on thermodynamic/practical grounds. The injection of hot gas into the suction line is undesirable from the point of view of reducing suction gas temperature. To keep the actual amount of gas to a minimum the injection point should be right next to the bulb.

The positive feedback system can also be modified as was done with the negative feedback system when derivative action was obtained. In this case integral action is obtained and $A = +f(F,t)$. This configuration using a proportional and integral control is shown in FIG. 8 where the time delay is once again shown as being obtained by a capacity and restrictors. In FIG. 8 the normal proportional control is achieved through the wet vapour by-pass line 15 and the positive feedback with integral control is provided through by-pass line 41 which incorporates restrictors 42 a heater 43 and a capacity 44.

In a similar manner a system may be provided with variable sensitivity, integral action, and derivative action as shown in FIG. 9. In this configuration the normal wet vapour injection line is provided at 45 in parallel with a wet vapour/time function injection (derivative) line 46 incorporating a capacity 47 and valves/restrictors 48. The by-pass line 45 joins the evaporator at junction 49 just downstream from the transition point in the evaporator and the line 46 joins the evaporator just upstream from the temperature sensing bulb 12. A further hot gas/time function (integral) by-pass line 50 is also provided in parallel with the by-pass line 46 and incorporating valves/restrictors 51, a heater 52, and a capacity 53. The by-pass line 50 also joins the evaporator at junction 54 just upstream of the temperature sensing bulb 12.

The systems described above enable a feedback control system for a TX valve to be provided which enables hunting of the valve to be reduced or eliminated in a number of different ways. The simple negative feedback proportional control may be achieved in the configuration shown in FIGS. 2 and 3 and where further control of the TX valve is required this may be provided using the modifications shown in FIGS. 7 to 10.

Each of the systems described above is particularly suitable for use with heat pumps of the solar assisted type for example as described in our Australian Pat. No. 509,901. In this application maximum efficiency is difficult to attain due to wide variations in heat input and the low thermal inertia of the evaporation plate. The invention of course has wider applications to air conditioning and refrigeration systems generally.

The effect of the invention may be readily seen with reference to FIGS. 10 and 11 wherein FIG. 10 is a graph of temperature against time for an experimental solar assisted heat pump of the prior art type with unstable control and FIG. 11 is the same graph of a similar heat pump using a control system according to the invention. It will be seen that the invention considerably reduces the hunting effect of the TX valve resulting in a much more stable and efficient system.

I claim:

1. A refrigeration system including an evaporator controlled by an expansion valve having means for sensing the temperature or vapour dryness at the downstream end of the evaporator, characterized by means for injecting wet vapour at a rate which is a function of the rate of flow of refrigerant through the expansion valve into said evaporator upstream of said temperature sensing means.

2. A refrigeration system as claimed in claim 1 wherein said means for injecting wet vapour comprise a by-pass line between the outlet from the expansion valve and a position upstream of said temperature sensing means.

3. A refrigeration system as claimed in claim 2 wherein said by-pass line incorporates a heater.

4. A refrigeration system as claimed in claim 2 wherein said position is directly upstream of said temperature sensing means.

5. A refrigeration system as claimed in claim 2 wherein said position is spaced upstream from said temperature sensing means by a predetermined distance within the heat absorbing part of the evaporator.

6. A refrigeration system as claimed in any one of claims 1 to 4 wherein said system includes a pressure equalizer line from said expansion valve to the downstream end of said evaporator upstream from said temperature sensing means and wherein said by-pass line comprises in series a conduit communicating between the outlet from said expansion valve and the expansion valve end of said pressure equalizer line and the pressure equalizer line.

7. A refrigeration system as claimed in claim 6 wherein said conduit is incorporated within said expansion valve.

8. A refrigeration system as claimed in any one of claims 2 to 5 wherein a second by-pass line is provided in parallel with the first said by-pass line, said second by-pass line incorporating in series restrictors and a capacity.

9. A refrigeration system as claimed in claim 8 wherein said second by-pass line also incorporates a heater.

10. A refrigeration system as claimed in claim 8 wherein a third by-pass line is provided in parallel with said first and second by-pass line, said third by-pass line incorporating in series a restrictor a heater and a capacity.

* * * * *